United States Patent [19]

Dabkowski et al.

[11] Patent Number: 4,661,241

[45] Date of Patent: Apr. 28, 1987

[54] DELAYED COKING PROCESS

[75] Inventors: Michael J. Dabkowski, Mickleton; Madhava Malladi, West Deptford, both of N.J.

[73] Assignee: Mobil Oil Corporation, New York, N.Y.

[21] Appl. No.: 718,328

[22] Filed: Apr. 1, 1985

[51] Int. Cl.[4] ..... C10G 9/14

[52] U.S. Cl. ..... 208/131; 208/56; 208/107

[58] Field of Search ..... 208/131, 50, 56, 132, 208/107

[56] References Cited

U.S. PATENT DOCUMENTS

| | | | |
|---|---|---|---|
| 2,380,713 | 7/1945 | Wilson | 208/131 |
| 2,843,530 | 7/1958 | Langer, Jr. et al. | 208/56 |
| 3,257,309 | 6/1966 | Fauchier et al. | 208/132 |
| 3,687,840 | 8/1972 | Sze et al. | 208/50 |
| 4,036,736 | 7/1977 | Ozaki et al. | 208/131 |
| 4,049,538 | 9/1977 | Hayashi et al. | 208/50 |
| 4,066,532 | 1/1978 | Garcia | 208/50 |
| 4,176,052 | 11/1979 | Bruce et al. | 208/131 |
| 4,213,846 | 7/1980 | Sooter et al. | 208/131 |
| 4,404,092 | 9/1983 | Audeh et al. | 208/131 |
| 4,430,197 | 2/1984 | Poynor et al. | 208/56 |
| 4,492,625 | 1/1985 | Allan | 208/131 |
| 4,518,486 | 5/1985 | Jansma | 208/131 |
| 4,519,898 | 5/1985 | Allan | 208/131 |

*Primary Examiner*—Andrew H. Metz
*Assistant Examiner*—Anthony McFarlane
*Attorney, Agent, or Firm*—Alexander J. McKillop; Michael G. Gilman; Malcolm D. Keen

[57] ABSTRACT

A delayed coking process having improved liquid yield and liquid product distribution relative to coke yield is characterized by the absence of heavy recycle. The coker feedstock is heated in the coker furnace and led to the coker drums where coking takes place and the vaporous effluence are passed to a fractionator from which the heavy gas oil fraction is removed as product. Process heat is conserved by indirect heat exchange of the feedstock with the coking products prior to the feedstock entering the coking furnace. A further improvement in liquid yield and selectivity is obtained by adding a solvent or diluent to the feedstock and this may be either a hydrocarbon fraction such as a coker distillate, a light gas oil or another fraction having an end point below 450° C.; in addition, it may be used in conjunction with a reactive or nonreactive gas such as nitrogen, steam, hydrogen or hydrogen sulfide.

20 Claims, 4 Drawing Figures

DELAYED COKING PROCESS

FIELD OF THE INVENTION

This invention relates to a delayed coking process and more particularly, to a delayed coking process which minimizes the yield of coke and maximizes the yield of less refractory liquid products.

BACKGROUND OF THE INVENTION

The delayed coking process is an established petroleum refinery process which is used on very heavy low value residuum feeds to obtain lower boiling cracked products. It can be considered as a high severity thermal cracking or destructive distillation and may be used on residuum feedstocks containing nonvolatile asphaltic materials which are not suitable for catalytic cracking operations because of their propensity for catalyst fouling or for catalyst deactivation by their content of ash or metals. Coking is generally used on heavy oils, especially vacuum residua, to make lighter components that can then be processed catalytically to form products of higher economic value. In the delayed coking process, the heavy oil feedstock is heated rapidly in a tubular furnace from which it flows directly to a large coking drum which is maintained under conditions at which coking occurs, generally with temperatures above about 450° under a slight superatmospheric pressure. In the drum, the heated feed decomposes to form coke and volatile components which are removed from the top of the drum and passed to a fractionator. When the coke drum is full of solid coke, the feed is switched to another drum and the full drum is cooled and emptied of the coke product. Generally, at least two coking drums are used so that one drum is being charged while coke is being removed from the other.

In order to bring the feedstock up to the required temperature and to conserve process heat, the feedstock is usually charged to the base of the fractionator tower which receives the overheads from the coke drum. The feed to the furnace is taken from the bottom of the fractionator or "combination" tower and the products of the coking process, including heavy coker gas oil, light coker gas oil and coker gasoline are removed from higher levels in the tower. The use of the tower bottoms as the feed for the coker furnace has three main objectives. First, heavy fractions which are recycled through the unit will be further cracked to lower boiling products which have greater utility even though the yield of coke ("coke make") is increased by this recycling; second, the metals content of the products is reduced as the coke make increases because the metals tend to accumulate in the coke; third, use of the recycle as diluent tends to reduce coking in the furnace. Coking in the furnace is a significant problem in delayed coking operations because although the yields of coke and gas may be reduced by operating the coking drums at higher temperatures, the higher temperatures which are required in the furnace to provide them, lead to excessive fouling in the tubes of the furnace, with a concommitantly greater maintenance requirement to clean the furnace tubes. Furnace fouling may be reduced by using an inert gas stripper, usually steam, but even then the practical limitations on furnace conditions generally constitute the principal impediment to improved operation of the coker.

Present trends in the petroleum refining industry are making it more and more desirable to increase the yield of lighter products, especially gasoline and distillates, from residual products which themselves are becoming heavier and more difficult to process. This requires a significant increase in residual oil upgradng capacity but because this generally requires major capital expenditure, it would be desirable to find some way of increasing the yield of lighter products using existing equipment. At the present, most delayed coker units are limited by the coke make, that is, by the amount of coke which they produce relative to the yield of cracked products. Although, as mentioned above, the yield of cracked products may be increased by operating at higher temperatures, this is generally not practicable because of the increased downtime required for furnace maintenance. Therefore, any improvement in the delayed coker process should preferably be accomplished without the necessity of operating under conditions which lead to increased furnace fouling and generally this will mean that increases in furnace temperature will normally have to be avoided.

One shortcoming of existing delayed coking technology is that with the heavier crudes now being employed in refineries, relatively large coke yields (of the order of 30 to 40 weight percent) are obtained, with a nonselective yield distribution of relatively low quality, refractory liquid products. The yield distribution is, of course, difficult to control in a purely thermal operation with a given type of feed and therefore offers only a limited potential for improvement. However, the large coke yield and the quality of the liquid product can be attributed to the use of the fractionator or combination tower in which the feedstock is directly heat exhanged with the vaporous effluent from the coker drums. Although this serves to conserve process heat, it also results in the heaviest components of the coker effluent being condensed and returned as recycle to the furnace, generally in amounts which range from 5 to 40 percent of the fresh coker feed, depending on the operational and heat requirements of the particular unit. Although the recycle is highly refractory and, as previously mentioned, tends to reduce coking in the furnace, it nevertheless produces a significant amount of coke so that the final coke yield is increased. Furthermore, the liquid products derived from the heavy recycle tend to be more refractory and of lower quality than the liquid products from fresh feed of the same boiling range.

One proposal for reducing the coke yield in a delayed coker unit is set out in U.S. Pat. No. 4,455,219 which modifies the conventional delayed coking process by reducing the amount of heavy recycle which is returned to the furnace and adding an additional, lighter feedstock component, either from the coker fractionator or from some other source. In this process, the amount of heavy coker gas oil which is returned to the lower section of the fractionator tower is held to the minimum amount necessary for operation of the fractionator, with the balance delivered as product from the unit. This results in a decrease in the amount of recycle, the deficiency being made good by added light distillate which is introduced into the feedstock before it is charged to the base of the fractionator. This proposal does not, however, deal effectively with the problem of the quality and distribution of the liquid products even though some decrease in coke make might be obtained. The reason for this is that only the lighest portion of the heavy recycle stream is removed. The heavier components are returned in the normal way and continue to participate in the process, with the undesirable effects alluded to above. There remains, therefore, a continuing need for improvements in the delayed coking process.

SUMMARY OF THE INVENTION

It has now been found that the delayed coking process may be improved by eliminating the heavy reycle component in the coker feed, using a single pass operation in which the feed to the coker unit passes through the unit without recycle of the coking products. Significant reductions in coke yield with concomitant increases in liquid yield and improved yield distribution are obtained. For a coke drum of given size, operating at comparable conditions of temperature, pressure and fresh feed rate, single pass operation gives a higher liquid/coke ratio than conventional operations using heavy recycle and the products from single pass operation are less refractory than those obtained with conventional recycle. Process heat for single pass operation can be conserved by providing various types of indirect heat exchange between the coker feed and the coking products, instead of the conventional direct mixing with the vaporous coker effluents in the fractionator.

A further improvement in the selectivity for liquid products may be obtained by the addition of various diluents or solvents in the feedstock, especially of single or multicomponent hydrocarbon materials, especially in the range of $C_1$ to $C_{50}$ hydrocarbons. Inert or reactive gases such as nitrogen, steam, hydrogen or hydrogen sulfide may also be used as a diluent with or without added solvent.

The DRAWINGS

In the accompanying drawings

DETAILED DESCRIPTION

In delayed coking processes, a heavy hydrocarbon feedstock is heated to a coking temperature usually at least 450° C. and typically in the range of 450° to 500° C. in a furnace from which it proceeds to a coking drum which is maintained under conditions at which coking occurs, typically at temperatures of at least 450° C. and under mild superatmospheric pressure, typically 35 to 700 kPa (5–100 psig). In the coking drum, thermal cracking takes place with the production of coke and the vaporous products of cracking leave the coke drum as overheads to pass to the fractionating or combination tower through which, in a conventional delayed coking operation, the feedstock also passes.

Figure 1:
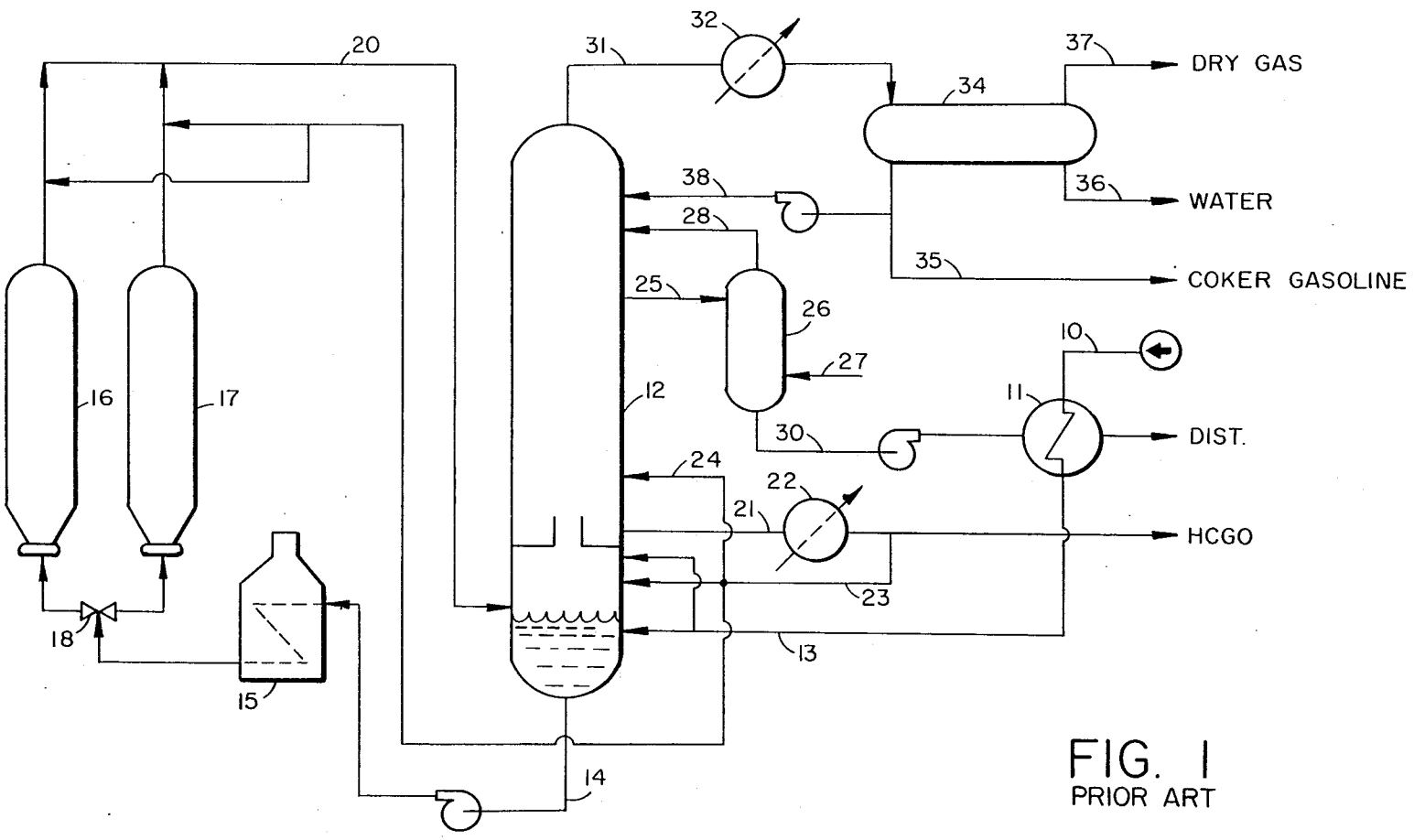
FIG. 1 PRIOR ART
FIG. 1 is a simplified schematic representation of a conventional delayed coker unit.

A conventional delayed coker unit is shown in FIG. 1. The heavy oil feedstock, usually a vacuum residuum, enters the unit through conduit 10 and passes through heat exchanger 11 where it is warmed. The warmed feedstock then enters fractionating tower 12 by way of conduit 13, entering the tower below the level of the coker drum effluent. In many units the feed also often enters the tower above the level of the coker drum effluent. The feed to the coker furnace, comprising fresh feed together with the tower bottoms fraction, is withdrawn from the bottom of tower 12 through conduit 14 through which is passes to furnace 15 where it is brought to a suitable temperature for coking to occur in delayed coker drums 16 and 17, with entry to the drums being controlled by switching valve 18 so as to permit one drum to be on stream while coke is being removed from the other. The vaporous cracking products of the coking process leave the coker drums as overheads and pass into fractionator 12 through conduit 20, entering the lower section of the tower below the chimney.

Heavy coker gas oil is withdrawn from fractionator 12 through conduit 21 and passes through cooler 22 prior to removal from the unit. A portion of the cooled gas oil is withdrawn through conduit 23 and returned to fractionator 12, entering both above and below the chimney through conduit 23 and branch conduit 24 in order to assure proper operation of the fractionator. Return of the gas oil fraction to the fractionator in this way helps to condense the heavier components of the coker effluent entering from the coke drums and to ensure that volatile components of the gas oil fraction evaporates to the higher levels in the tower. Additional gas oil may be introduced into drum effluent line 20 to provide a means for cooling the vaporous reaction products.

Distillate is removed from the tower through conduit 25 and is steam stripped in stripper 26 with steam supplied through steam line 27; the stripper effluent is returned to the tower through conduit 28. Distillate product is withdrawn from the unit through conduit 30, passing through heat exchanger 11 where it gives up heat to the feedstock.

Coker wet gas leaves the top of the column through conduit 31 passing through heat exchanger 32 into separator 33 from which coker gasoline, water and dry gas are obtained, leaving the unit through conduits 35, 36, and 37 with a reboil fraction being returned to the fractionator through conduit 38.

The amount of heavy recycle material which is returned to the furnace and coker drums varies according to the nature of the feedstock being used. In broad terms, the recycle component will generally range from about 5 to about 70% of the fresh feed to the unit, with good quality feedstock typically requiring from 10 to 30% recycle and heavier materials from 30 to 70% in order to avoid undesirable coking in the furnace and to produce a product which has an acceptably low content of metals and other impurities. During the coking process, the metals which are mostly present as soluble porphyrins and other compounds tend to remain in the coke so that the gas oil product has a relatively reduced metals content, principally of nickel and vanadium, making it more suitable for use as a feedstock in catalytic operations such as FCC and hydrocracking. However, the use of the heavy recycle is undesirable in that it reduces the production capacity of the coker, it increases the coke yield measured as a percentage of the fresh feed and leads to the formation of aromatic, highly refractory products which are not easily processed in subsequent units. Furthermore, the yield distribution of the various liquid products is undesirable and the high yield of coke is associated with a high gas yield which again, is undesirable.

Reducing the amount of recycle directionally reduces the coke and gas make and increases liquid yields, particularly the gas oil fraction (345° C.+ (650° F.+) fraction) since the end point of this material increases as recycle decreases (in a conventional operation, it is the heaviest components of the total coker effluent which are recycled and diminution in the recycle permits these components to pass straight out of the unit). Taken to the limit of zero recycle in a single pass coking operation, significant reductions in coke make and an increase in liquid yield are obtained. For a given coke drum, operated at a given temperature, pressure and fresh feed rate, single pass operation gives a higher liquid/coke ratio than any conventional heavy recycle/fresh feed combination and the products from single pass operation are less refractory than recycle products from the same boiling range. In a single pass operation, the feedstock may be heated and process heat conserved by indirect heat exchange between the coker feed and various coker products instead of the conventional direct heat exchange with the coker effluent in the combination tower.

Single pass coking is particularly useful with heavy residual feeds which conform to at least one of the characteristics below. Normally, when one of these parameters is satisfied, the other two will also be and therefore, in most cases, the feed should conform to all three limitations.

TABLE 1

| | Feed Properties | | |
|---|---|---|---|
| | Broad | Intermediate | Limited |
| °API | 17.0 | 12.0 | 9.0 |
| CCR, min. | 7.0 | 10.0 | 14.0 |
| Asphaltenes, min. | 2.0 | 3.0 | 4.5 |

Notes:
1. °API by ASTM D-287
2. CCR, wt. percent, by ASTM D-189
3. Asphaltenes, wt. percent insolubles, extraction with n-heptane under reflux Examples of such feedstocks include residues from the atmospheric or vacuum distillation of petroleum crudes or the atmospheric distillation of heavy oils, visbroken resids, tars from deasphalting units or combinations of these materials.

Figure 2:
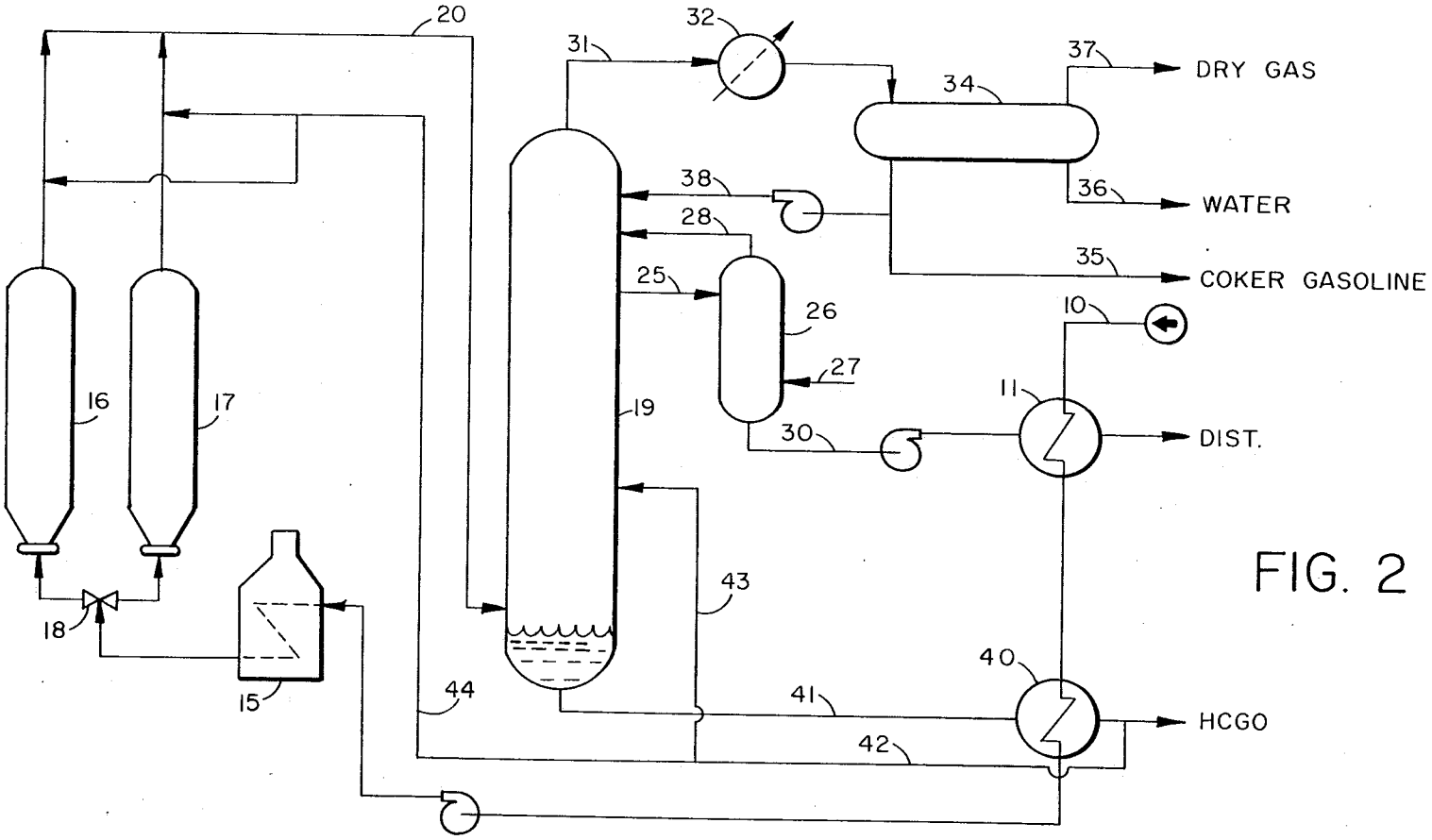
FIG. 2 is a simplified schematic representation of a delayed coker unit employing single pass operation.

FIG. 2 illustrates a simplified schematic representation of a single pass delayed coking unit without heavy recycle. The unit comprises the conventional coker furnace, delayed coking drums, and facilities for handling the distillate and more volatile fractions. Accordingly, these parts of the unit are given the same reference numerals as in FIG. 1. In this unit, fresh feed enters in the conventional manner through conduit 10 and passes through heat exchanger 11 where it picks up heat from distillate product stream leaving the unit through conduit 30. It then passes through heat exchanger 40 in which it picks up additional heat from the heavy coker gas oil HCGO product steam, after which it passes to furnace 15 and thence to the coker drums 16 and 17 by way of switching valve 18. A fresh feed surge drum (not shown) may be added upstream of the furnace if necessary. Vaporous effluents from the coker drums are removed as overheads through conduit 20 and returned to the bottom section of the fractionator tower 19. The effluent from the coker drums is fractionated in tower 19, with the coker wet gas being removed through conduit 31 and a distillate fraction through conduit 25. The heavy coker gas oil product (HCGO) is removed as tower bottoms and passes directly out of the unit through conduit 41 without providing recycle. A portion of the HCGO product is returned to the upper section of the fractionator through conduits 42 and 43 in order to ensure proper fractionator operation by maintaining sufficient liquid in the fractionator and maintaining a proper downflow in the lower portion of the fractionator to ensure that heavy components of the coker effluents are brought down into the lower section of the tower. A further portion of the HCGO product stream passes, if desired, through conduit 44 to quench the vapors from coker drums 16 and 17, preventing coke deposition in the effluent vapor lines.

Because the feedstock enters the furnace directly without passing through the fractionator to undergo direct heat exchange with the coking reaction products, the design and construction of the tower may be simplified since there is no longer any need to provide for this heat exchange. The bottom section of tower 19 may therefore be simpler than that of combination tower 12 with its characteristic bottom section and chimney. Instead, tower 19 may be constructed as a simple fractionator, to give the desired cut points, as shown. However, it may be necessary to add a solids filter downstream of the heavy oil outlet because some solids carryover may be expected; the conventional combination tower acts as a filter for suspended solids by returning them in the recycle to the coker but in the present arrangement it may be necessary to make alternative provision for dealing with solids in the tower bottoms.

Further improvements in the liquid/coke ratio and product selectivity may be obtained by the addition of various diluents or solvents to the feedstock. This may be achieved by direct addition of the desired diluent or solvent to the feedstock either from outside sources or from the coker unit itself. In the delayed coking unit shown in FIG. 3, a portion of the coker distillate product is added as diluent to the fresh feed through conduit 45. Alternatively, the distillate may be added to the feed line before the distillate passes through heat exchanger 11, using conduit 46. As other alternatives, the distillate diluent may be added to the feed after the feed has passed through heat exchanger 11, using conduits 47 or 48.

Figure 3:
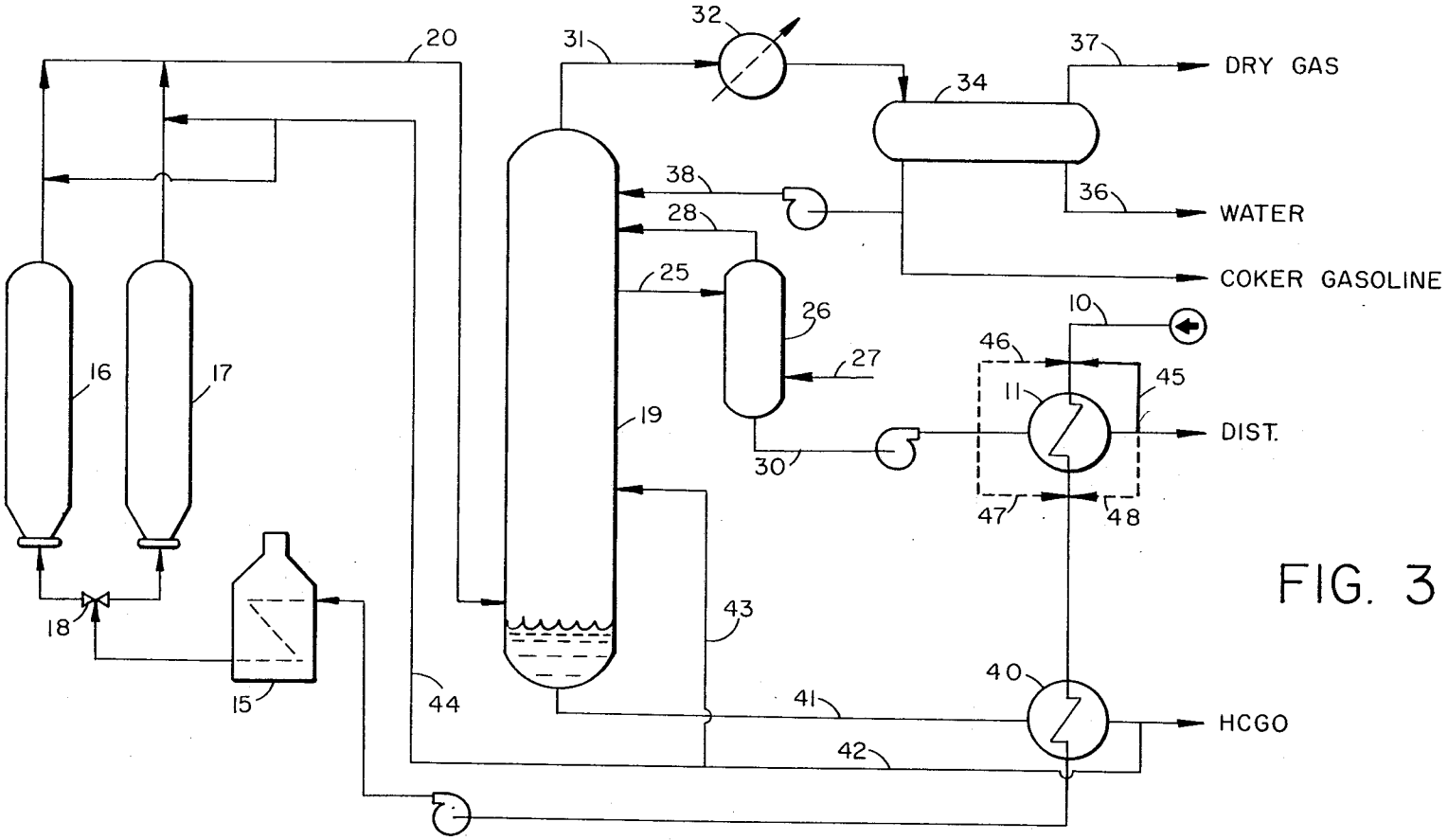
FIG. 3 is a simplified schematic representation of a delayed coker unit employing single pass operation with the addition of solvent to the feed.

Solvents which may be used include any naturally occurring, synthetic or processed (i.e. distillate, deasphalted, hydrotreated, catalytically cracked, etc.) hydrocarbons, either as single compounds or multicomponent materials. They may be obtained directly from the coker unit as shown in FIG. 3 or derived from other sources. The end point of hydrocarbon solvents used in this way should be not more than 450° C. (about 850° F.) and generally the solvents will be $C_1$ to $C_{50}$ hydrocarbons. In order to maintain the advantages of single pass coking, however, it is desirable to avoid the use of solvents with initial boiling points above about 345° C. (about 650° F.) and for this reason, solvents boiling below about 345° C. (about 650° F.) are preferred. Generally, the solvent will be a distillate boiling range material, i.e. having a boiling range from about 165° to 350° C. (about 330° to 650° F.) and within this range may be either a light or a heavy distillate. However, more volatile hydrocarbons may be used, for example, hydrocarbons in the gasoline boiling range or even dry gas.

It is particularly preferred to cofeed a hydrogen donor solvent with the fresh feed since this provides the potential for increasing the hydrogen:carbon ratio of the feed so as to produce more light hydrocarbons or a higher quality hydrocarbon. Single component hydrogen donor solvents such as tetralin (tetrahydronaphthalene) and other polycyclic hydroaromatic compounds which are capable of donating hydrogen in hydrogen transfer reactions may be used but for purposes of economy, it will normally be preferred to use a refinery stream of appropriate boiling point, i.e. preferably below about 345° C. (about 650° F.), which contains a suitable proportion of hydroaromatic components. Refinery streams of this kind may be produced by hydrotreating aromatic feedstocks, for example, over a cobalt-molybdenum or other conventional hydrotreating catalysts.

The solvent or combination of solvents may be added to the fresh feed at any point prior to the coking drums and the actual point selected will depend upon the nature of the feed and the results which are desired. Thus, for example, the solvent may be added to a vacuum residuum directly after the vacuum tower, during transfer from storage or before or after the coker furnace, for example, by adding the solvent, heated to a suitably high temperature, by sparging into the coke drum. If a hydrogen donor solvent is used and the residuum feed is initially at a relatively high temperature, it is preferred to add the solvent relatively early in the process so as to maximize the potential for hydrogen transfer reactions which will facilitate the production of the more volatile products during the subsequent coking operation, although hydrogen donor diluents may also be added to the coke drum directly by sparging.

The amount of hydrocarbon solvent or diluent added to the fresh feed will generally be from 1 to 40 weight percent, preferably 5 to 25 weight percent, of the feed. With the heavier crude feeds, the amount of solvent will usually be at least 10 weight percent of the fresh feed.

In addition, an inert or a reactive gas may be used as a diluent for the coking operation. For this purpose, essentially inert gases such as nitrogen and steam or reactive gases such as hydrogen or hydrogen sulfide may be added to the feedstock, either before or after the furnace, with or without addition of the hydrocarbon solvent.

The invention is illustrated in the following Examples in which all parts, proportions and percentages are by weight unless stated to the contrary.

EXAMPLE 1

To illustrate the effect of single pass coking on reducing coke make, a series of laboratory pilot plant coking runs were done on commercial coker feedstocks (Table 2). Furnace feed samples (Feeds 2 and 4) were composed of the corresponding fresh feed (Feeds 1 and 3) together with the heavy coker recycles to the commercial coker units.

The various coker feedstocks were coked in a laboratory delayed coker semi-batch pilot unit. Operation for each run was in a once through mode at 468° C. (875° F.) charging 7 cc/min for 4 hours, followed by a 2 hour soak period at 468° C. (875° F.) to remove remaining volatiles from the drum. Table 3 lists the operating pressure and amount of recycle in each feed for each run made. The corresponding coker yields corrected to a fresh feed basis are also shown in Table 3. Coke was reduced an average of 12.2% and 10.8% and $C_5$+ liquid yields increased by 9.9% and 7.1% when reducing recycle from 18% to 0% (single pass) at 550 kPa (65 psig) and 345 kPa (35 psig), respectively.

Comparison of the second pair of feedstocks at 550 kPa (65 psig) shows a 14.7% reduction in coke make, 14.4% reduction in $C_4$− gas make, and a corresponding 13.6% increase in $C_5$+ liquid yield when reducing recycle from 22% to single pass (Runs 14 and 15).

Table 4 compares the properties of the liquid products from each of the coker runs. Compared with recycle operation, single pass operation generally results in products which are less dense, higher in hydrogen, similar or lower in sulfur and nitrogen contents, and higher in molecular weight yet less aromatic. This illustrates the more refractory nature of products derived through recycle operations. These trends also generally hold true when comparing the 345°-455° C. (650°-850° F.) gas oil from recycle operation with the entire 345° C.+ (650° F.+) gas oil which would result from single pass operation, i.e., there would be little 455° C.+ (850° F.+) product in actual recycle operation. Despite the much larger yield of heavier material in single pass operation, the only negative effect is higher CCR and metal content resulting from inclusion of the higher boiling material but these remain within limits which can be tolerated in other processing units, especially catalytic units such as fluid catalytic crackers (FCC).

TABLE 2

| | Coker Chargestock Properties | | | |
|---|---|---|---|---|
| Description | Feed 1 Fresh Feed | Feed 2 Furnace Feed | Feed 3 Fresh Feed | Feed 4 Furnace Feed |
| °API | 5.6 | 6.6 | — | 7.7 |
| Hydrogen, Wt % | 10.49 | 10.24 | 10.61 | 10.53 |
| Sulfur, Wt % | 2.10 | 2.00 | 1.80 | 1.50 |
| Nitrogen, Wt % | — | — | 1.31 | 1.19 |
| Nickel, ppm | 90 | 80 | 140 | 105 |
| Vanadium, ppm | 100 | 80 | 130 | 96 |
| CCR, Wt % | 16.60 | 13.56 | 15.41 | 12.15 |
| Asphaltenes, n-C5, Wt % | 17.61 | 14.42 | 14.56 | 12.78 |
| Asphaltenes, n-C7, Wt % | — | — | 6.52 | 5.51 |
| $C_A$, Wt % | — | — | 38 | 35 |
| D1160-1, Vol % - °C.(°F.) | | | | |
| IBP | 418 (785) | 253 (488) | 410 (771) | 265 (510) |
| 5 | 494 (922) | 326 (619) | 477 (891) | 339 (643) |
| 10 | 511 (952) | 400 (750) | 500 (933) | 387 (729) |
| 30 | — — | 518 (965) | 576 (1069) | 494 (922) |
| EP | 28% at 586 (1087) | 48% at 593 (1100) | 40% at 589 (1092) | 46% at 562 (1044) |
| Recycle, Wt % (Calc.) | — | 18% | — | 22% |

TABLE 3

Coker Runs and Yields

| Run No. | Run Description | Recycle, Wt % | Pressure kPa(psig) | Yields, Wt % (Fresh Feed) Coke | $C_4$- | $C_5$-400° F. | 400°-650° F. | 650° +F. | Total $C_5$+ |
|---|---|---|---|---|---|---|---|---|---|
| 1 | Recycle, Feed 2 | 18 | 550 (65) | 35.1 | 13.2 | 21.6 | 20.1 | 9.9 | 51.6 |
| 3 | Recycle, Feed 2 | 18 | 550 (65) | 34.8 | 13.2 | 23.2 | 19.4 | 9.5 | 52.1 |
| 2 | Single Pass, Feed 1 | — | 550 (65) | 30.5 | 12.5 | 19.9 | 21.6 | 15.6 | 57.1 |
| 4 | Single Pass, Feed 1 | — | 550 (65) | 30.8 | 12.3 | 20.9 | 19.6 | 16.5 | 57.0 |
| 5 | Recycle, Feed 2 | 18 | 343 (35) | 32.1 | 11.4 | 18.4 | 21.0 | 17.1 | 56.5 |
| 7 | Recycle, Feed 2 | 18 | 343 (35) | 30.5 | 11.1 | 20.5 | 15.5 | 22.4 | 58.4 |
| 6 | Single Pass, Feed 1 | — | 343 (35) | 28.6 | 9.7 | 18.4 | 18.9 | 24.4 | 61.7 |
| 8 | Single Pass, Feed 1 | — | 343 (35) | 27.2 | 11.4 | 17.0 | 17.7 | 26.7 | 61.4 |
| 15 | Recycle, Feed 4 | 22 | 550 (65) | 34.0 | 14.6 | 23.3 | 21.9 | 6.3 | 51.5 |
| 14 | Single Pass, Feed 3 | — | 550 (65) | 29.0 | 12.5 | 20.4 | 19.0 | 19.1 | 58.5 |

TABLE 4

Coker Product Properties

| | Recycle Feed 2 | Single Pass Feed 1 | | Recycle Feed 2 | Single Pass Feed 1 | | Recycle Feed 4 | Single Pass Feed 3 |
|---|---|---|---|---|---|---|---|---|
| Operating Pressure, kPa (psi) | 550 (65) | 550 (65) | | 343 (35) | 343 (35) | | 550 (65) | 550 (65) |
| Naphtha (IBP-400° F.) | | | | | | | | |
| °API | 55.9* | 56.6* | | 54.7* | 55.4* | | 56.4 | 54.7 |
| Hydrogen, Wt % | 13.96 | 14.06* | | 13.92 | 13.78* | | 13.89 | 13.73 |
| Sulfur, Wt % | 1.04 | 1.08* | | 1.22 | 1.12* | | 0.90 | 1.05 |
| Nitrogen, Wt % | .055 | .057* | | 0.049 | 0.068* | | 0.0840 | 0.0770 |
| Aromatics + Olefins, Wt % | 51.9 | 49.4* | | 54.9 | 53.9 | | 51.6 | 49.4 |
| Light Gas Oil (400-650° F.) | | | | | | | | |
| °API | 26.7* | 27.1* | | 28.2* | 28.8* | | 26.2 | 27.9 |
| Hydrogen, Wt % | 11.95 | 12.03* | | 12.12 | 12.27* | | 11.98 | 12.00 |
| Sulfur, Wt % | 1.44 | 1.43* | | 1.53 | 1.46* | | 1.28 | 1.42 |
| Basic Nitrogen, ppm | 2460 | 2330* | | 2290 | 1990 | | 2650 | 2220 |
| Molecular Weight | 199 | 212 | | 196 | 202 | | 199 | 198 |
| Paraffins, Wt % | — | 15.4 | | 16.8 | 13.7 | | 15.2 | 19.1 |
| Naphthenes, Wt % | — | 28.6 | | 23.4 | 28.0 | | 28.7 | 31.0 |
| $C_A$, by MS, Wt % | — | — | | 33.6 | 31.1 | | 31.8 | 30.0 |
| Heavy Gas Oil | | | | | | | | |
| Boiling Range, °F. | 650-850 | 650-850 | 650* | 650-850 | 650-850 | 650* | 650-850 | 650* |
| °API | 10.4* | 11.1 | 9.1 | 12.0* | 14.3 | 11.2* | 8.9 | 9.9 |
| Hydrogen, Wt % | 9.82 | 10.32 | 10.08 | 10.45 | 10.89 | 10.47* | 10.02 | 10.19 |
| Sulfur, Wt % | 1.33 | 1.30 | 1.32 | 1.39 | 1.27 | 1.29* | 1.18 | 1.27 |
| Basic Nitrogen, ppm | 4280* | 4210 | 4360 | 4130* | 3540 | 4030* | 4560 | 4290 |
| Molecular Weight | 278 | 286 | 305* | 283 | 302 | 330* | 275 | 294 |
| Paraffins, Wt % | 7.8 | 7.9 | 7.1 | 8.1 | 8.9 | 7.8* | 8.7 | 8.4 |
| Naphthenes, Wt % | 16.9 | 18.3 | 16.4 | 21.1 | 23.6 | 17.8* | 18.9 | 19.6 |
| $C_A$, by MS, Wt % | 45.2 | 39.1 | 38.8 | 39.6 | 31.3 | 33.7 | 42.9 | 45.4 |
| CCR, Wt % | 0.13* | 0.19 | 1.88* | 0.10* | 0.08 | 1.74* | 0.20 | 1.86 |
| Ni + V, ppm | — | — | 0.16 | — | — | 1.2 | — | 1.2 |
| Bottoms (850+) | | | | | | | | |
| °API | — | — | | 1.4 | 4.5 | | — | |
| Hydrogen, Wt % | 7.26 | — | | 8.61 | 9.59 | | — | |
| Sulfur, Wt % | — | — | | 1.26 | 1.21 | | — | |
| Basic Nitrogen, ppm | — | — | | 5170* | 4760 | | — | |
| Molecular Weight | 374 | 412 | | 391 | 412 | | 379 | |
| Paraffins, Wt % | — | 3.1 | | 2.0 | 2.0 | | — | |
| Naphthenes, Wt % | — | 6.9 | | 9.7 | 13.3 | | — | |
| $C_A$, by MS, Wt % | — | 37.4 | | 52.8 | 35.2 | | — | |
| CCR, Wt % | 10.98 | 13.61 | | 8.56* | 6.29 | | 7.47 | |
| Ni + V, ppm | — | — | | 1.85 | 1.94 | | — | |

Notes:
*Average analysis from two runs.

EXAMPLE 2

A series of delayed coker runs were made in a similar manner to that of Example 1 but with the addition of various solvents. The compositions of the coker feeds were as in Example 1 (Feeds 1-4); the compositions of the solvents are set out in Table 5 below. All but Solvent 1 (Coker Light Gas Oil) and Solvent 5 (Tetralin) were commercial samples originating from the same general crude source as the coker fresh feeds. Solvent 1 was a commercial coker light gas oil derived from a mixture of unrelated crudes.

TABLE 5

Solvent Properties

| Solvent | Solv. 1 Coker LGO | Solv. 2 Coker HGO | Solv. 3 Coker LGO | Solv. 4 FCC LCO | Solv. 5 Tetralin | Solv. 6 Coker Hvy Naphtha |
|---|---|---|---|---|---|---|
| °API | 32.4 | 12.2 | 28.2 | 21.5 | 5.8 | 47.1 |

TABLE 5-continued

| Solvent | Solv. 1 Coker LGO | Solv. 2 Coker HGO | Solv. 3 Coker LGO | Solv. 4 FCC LCO | Solv. 5 Tetralin | Solv. 6 Coker Hvy Naphtha |
|---|---|---|---|---|---|---|
| Solvent Properties | | | | | | |
| Hydrogen, Wt % | 12.66 | 10.30 | 12.04 | 10.87 | 9.15 | 13.56 |
| Sulfur, Wt % | 1.83 | 1.39 | 1.30 | 0.94 | — | — |
| Nitrogen, Wt % | 0.05 | 0.77 | 0.50 | 0.53 | — | — |
| CCR, Wt % | 0.03 | 0.46 | <0.05 | <0.01 | <0.01 | <0.01 |
| Asphaltenes, n-C5, Wt % | 0.13 | 0.49 | — | — | — | — |
| Asphaltenes, n-C7, Wt % | — | 0.11 | — | — | — | — |
| $C_A$, Wt % | — | 49 | — | — | 60 | — |
| Mol. Wt. | 203 | 282 | 201 | | 132 | — |
| D2887 Sim dist, % - °C.(°F.) | | | | | | |
| 5 | 192 (377) | 282 (539) | 186 (367) | 257 (494) | 208 (406) | 120 (249) |
| 50 | 270 (519) | 392 (738) | 277 (531) | 307 (585) | 208 (406) | 159 (319) |
| 95 | 388 (730) | 480 (897) | 375 (707) | 387 (728) | 208 (406) | 202 (395) |

The delayed coker runs were made in the same laboratory delayed coker semi-batch pilot unit using the same procedure (single pass, 468° C.; charge at 7 cc. $min^{-1}$ for 4 hours, 2 hours soak at 468° C.).

The operating pressures and the amount of the solvents used are shown in Table 6 below, together with the yields, corrected to a fresh feed basis. Table 7 below gives the properties of the liquid products.

TABLE 6

Coker Runs and Yields

| Run No. | Run Description | Solvent, Wt % | Pressure, kPa (psig) | Yields, Wt % (Fresh Feed) Coke | $C_4$- | $C_5$-400° F. | 400°-650° F. | 650° +F. | Total $C_5$+ |
|---|---|---|---|---|---|---|---|---|---|
| 11 | Feed 1 + Solv. 1 | 18 | 550 (65) | 29.8 | 13.6 | 22.4 | 16.1 | 18.2 | 56.7 |
| 13 | Feed 1 + Solv. 1 | 18 | 343 (35) | 26.8 | 11.2 | 20.6 | 14.0 | 27.4 | 62.0 |
| 20 | Feed 3 + Solv. 2 | 10 | 550 (65) | 29.9 | 12.4 | 22.0 | 16.4 | 19.2 | 57.6 |
| 21 | Feed 3 + Solv. 3 | 10 | 550 (65) | 26.6 | 11.6 | 19.8 | 17.6 | 24.4 | 61.8 |
| 24 | Feed 3 + Solv. 4 | 10 | 550 (65) | 29.8 | — | — | — | — | — |
| 16 | Feed 3 + Solv. 5 | 10 | 550 (65) | 27.4 | 11.6 | 21.5 | 19.0 | 20.6 | 61.1 |
| 23 | Feed 3 + Solv. 6 | 10 | 550 (65) | 28.8 | — | — | — | — | — |

TABLE 7

Coker Product Properties

| | Solvent Assisted Feed 1 + Solv. 1* | | Solvent Assisted Feed 1 + Solv. 1* | | Solvent Assisted Feed 3 + Solv. 2* | | Solvent Assisted Feed 3 + Solv. 3* | Solvent Assisted Feed 3 + Solv. 4* | Solvent Assisted Feed 3 + Solv. 5* | Solvent Assisted Feed 3 + Solv. 6* |
|---|---|---|---|---|---|---|---|---|---|---|
| Operating Pressure, kPa (psi) | 65 | | 35 | | 65 | | 65 | 65 | 65 | 65 |
| Naphtha (IBP-400° F.) | | | | | | | | | | |
| °API | 57.8 | | 53.5 | | 51.0 | | 55.0 | | 55.2 | 50.0 |
| Hydrogen, Wt % | 14.09 | | 13.61 | | 13.60 | | 13.94 | | 13.82 | 13.66 |
| Sulfur, Wt % | 0.93 | | 0.94 | | 1.01 | | 1.00 | | 0.84 | 1.11 |
| Nitrogen, Wt % | 0.056 | | 0.059 | | 0.650 | | 0.790 | | .069 | .057 |
| Aromatics + Olefins, Wt % | 50.9 | | 56.9 | | 53.0 | | 54.9 | | 53.5 | 49.9 |
| Light Gas Oil (400-650° F.) | | | | | | | | | | |
| °API | 28.7 | | 29.5 | | 28.6 | | 27.3 | | 22.6 | 27.3 |
| Hydrogen, Wt % | 12.18 | | 12.48 | | 12.14 | | 12.03 | | 10.92 | 12.01 |
| Sulfur, Wt % | 1.71 | | 1.69 | | 1.39 | | 1.36 | | 1.04 | 1.40 |
| Basic Nitrogen, ppm | 1430 | | 1330 | | 2150 | | 2290 | | 1740 | 2220 |
| Molecular Weight | 193 | | 204 | | 201 | | 190 | | 180 | 198 |
| Paraffins, Wt % | — | | 21.4 | | 18.5 | | 16.3 | | 12.2 | 15.6 |
| Naphthenes, Wt % | — | | 29.6 | | 26.3 | | 25.6 | | 18.0 | 29.1 |
| $C_A$, MS, Wt % | 34.3 | | 27.5 | | 28.8 | | 34.9 | | 42.2 | 36.2 |
| Heavy Gas Oil | | | | | | | | | | |
| Boiling Range, °F. | 650-850 | 650+ | 650-850 | 650+ | 650-850 | 650+ | 650+ | | 650+ | 650+ |
| °API | 12.0 | — | 15.8 | — | 12.7 | — | 7.1 | | 9.7 | 8.0 |
| Hydrogen, Wt % | 10.41 | — | 11.09 | — | 10.41 | — | 9.52 | | 10.06 | 9.90 |
| Sulfur, Wt % | 1.71 | — | 1.62 | 1.48 | 1.30 | — | 1.29 | | 1.34 | 1.39 |
| Basic Nitrogen, ppm | 3650 | — | 3070 | 3620 | 3682 | — | 4460 | | 4450 | 4400 |
| Molecular Weight | 296 | — | 280 | — | 273 | — | 200 | | 300 | 318 |
| Paraffins, Wt % | 8.6 | — | 7.7 | — | 10.0 | — | 6.2 | | 8.3 | 5.8 |
| Naphthenes, Wt % | 18.0 | — | 19.8 | — | 21.1 | — | 12.9 | | 22.5 | 14.9 |
| $C_A$, by MS, Wt % | 40.4 | — | 40.5 | — | 40.0 | — | 51.6 | | 43.0 | 44.0 |
| CCR, Wt % | 0.29 | 3.66 | 0.11 | 3.85 | 0.16 | 2.15 | 1.40 | | 1.46 | 2.66 |
| Ni + V, ppm | — | — | — | 3.2 | — | — | 1.4 | | 0.9 | 1.3 |
| Bottoms (850+) | | | | | | | | | | |

TABLE 7-continued

| | Coker Product Properties | | | | | | |
|---|---|---|---|---|---|---|---|
| | Solvent Assisted Feed 1 + Solv. 1* | Solvent Assisted Feed 1 + Solv. 1* | Solvent Assisted Feed 3 + Solv. 2* | Solvent Assisted Feed 3 + Solv. 3* | Solvent Assisted Feed 3 + Solv. 4* | Solvent Assisted Feed 3 + Solv. 5* | Solvent Assisted Feed 3 + Solv. 6* |
| Sulfur, Wt % | — | 1.19 | — | | | | |
| Basic Nitrogen, ppm | — | 4770 | — | | | | |
| CCR, Wt % | 16.29 | 11.71 | 20.19 | | | | |
| Ni + V, ppm | — | 9.9 | — | | | | |

Notes:
*Product properties not adjusted for solvent contribution.

The above results show that substitution of 18% light solvent (Solvent 1) for the entire heavy recycle reduces coke make an average of 2.8% and 3.9% below single pass yields at the two pressures (compare Runs Nos. 2, 4, 6, 8, 11 and 13).

The series of runs in which only 10% solvent was used as a substitute for the absent 22% heavy recycle showed that use of lighter solvents had a marked effect on coke make. Use of a heavy coker gas oil (Solvent 2) gave a 3.1% increase in coke make over single pass operation, indicating that some of the gas oil actually coked (compare Runs. Nos. 14 and 20). Use of lighter solvents may be expected to contribute nothing to coke make, or possibly decrease coke make monotonically with quantity vaporized if vaporization of the solvent were to have some effect. Coker light gas oil (Solvent 3), tetralin (Solvent 5) and coker heavy naphtha (Solvent 6) actually gave coke reductions of 8.3%, 5.5%, and 0.7%, gas make reductions of 7.2% and 7.2%, and $C_5$+ liquid increases of 5.6% and 4.4% (solvents 3 and 5) respectively. Comparison of solvent properties (Table 5) suggests that the hydrogen donatability of the solvent in the liquid state and the size of the vaporized molecules may be important in reducing coke yield through stabilizing or entraining cracked resid molecules.

Figure 4:
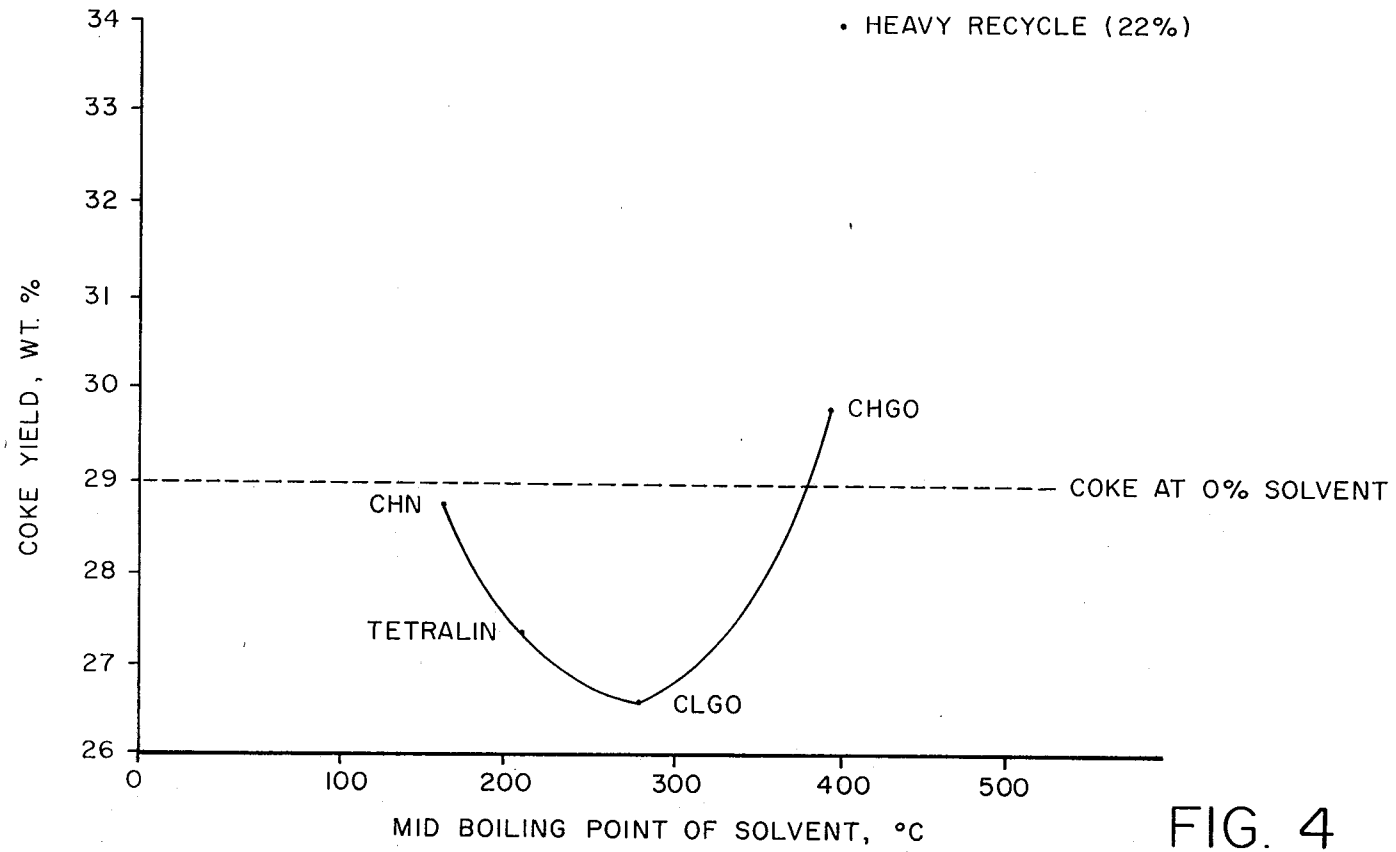
FIG. 4 is a graph relating the coke yield to the boiling range of the solvent added to the feed.

FIG. 4 is a graphic representation showing how coke yield varies with the mid boiling point of the solvent, based on the data in this Example (CHN is Coker Heavy Naphtha, Solvent 6; CLGO in Coker Light Gas Oil, Solvent 3; CHGO is Coker Heavy Gas Oil, Solvent 2). It indicates that there appears to be an optimum boiling range or solvent quality which minimizes coke yield for a given feedstock and for given operating conditions. It also indicates that an optimum solvent concentration or vapor-liquid ratio may be expected.

Reference to Table 7 shows that the products from solvent assisted coking are generally similar to those from single pass coking, with 650° F.+ gas oil properties continuing to reflect higher CCR and metals as yields increase through the entrainment of additional cracked resid. With an effective H-Donor such as Solvent 5 (tetralin), CCR and metals in the (345° C.+) (650° F.+) fraction were actually lower than in single pass operation. By varying the quality and quantity of the solvent the properties of the (345° C.+) (650° F.+) gas oil can be adjusted as desired.

We claim:

1. In a delayed coking process in which a heavy oil coker feedstock is heated to an elevated coking temperature in a furnace and the heated feedstock is subsequently subjected to delayed coking in a coker drum under superatmospheric pressure and the vaporous coking products are removed from the drum and passed to a coker fractionator from which a bottoms fraction is removed, the improvement comprising coking a feed without the addition of the bottoms fraction from the fractionator and adding to the feed to the coker drum a lower boiling hydrocarbon diluent having an end boiling point of not more than 450° C., the lower boiling hydrocarbon diluent being added to the heated feedstock after the feedstock has passed through the furnace.

2. A process according to claim 1 in which the diluent comprises a light gas oil.

3. A process according to claim 1 in which the hydrocarbon diluent is present in an amount from 1 to 40 percent of the fresh coker feedstock.

4. A process according to claim 1 in which the amount of the hydrocarbon diluent is from 5 to 25 percent of the fresh coker feedstock.

5. A process according to claim 1 in which the feedstock has a gravity of less than 12 °API.

6. A process according to claim 1 in which the feedstock has a gravity of less than 9 °API.

7. A process according to clam 1 in which the feedstock has a gravity of less than 12 °API and a Conradsen Carbon Residue greater than 10.0.

8. A process according to claim 1 in which the feedstock has a gravity of less than 9 °API and a Conradsen Carbon Residue greater than 14.0.

9. A process according to claim 1 in which the hydrocarbon diluent comprises a hydrogen donor diluent.

10. A process according to claim 1 in which the vaporous coking products are passed from the coker drum to a fractionator tower to produce fractionated coking products including a gas oil product which is withdrawn from the system, a portion of the gas oil product being returned to the fractionator to condense the vaporous coking products from the coker drum.

11. A process according to claim 10 in which a portion of the gas oil product is withdrawn to quench the vaporous coking products as they leave the coker drum.

12. A process according to claim 1 in which the hydrocarbon diluent comprises a liquid product of the coking process which is added as diluent to the fresh coker feedstock.

13. A process according to claim 1 in which the coker feedstock is cracked in the absence of added catalysts.

14. A process according to claim 13 in which the coker feedstock is cracked in the absence of added hydrogen.

15. A process according to claim 1 in which an inert gas diluent is added to the feedstock.

16. A process according to claim 15 in which the inert gas comprises steam.

17. A process according to claim 1 in which a reactive gas is added to the feedstock.

18. A process according to claim 1 in which the coker feedstock comprises a vacuum residuum.

19. A process according to claim 1 in which the hydrocarbon diluent comprises a hydrogen donor solvent.

20. A process according to claim 19 in which the hydrogen donor solvent comprises tetrahydronaphthalene.

* * * * *